US006213131B1

(12) United States Patent
Vien et al.

(10) Patent No.: US 6,213,131 B1
(45) Date of Patent: Apr. 10, 2001

(54) FINGERNAIL STENCILING SYSTEM

(76) Inventors: Larry Vien, 2101 Del Hollow St., Lakewood, CA (US) 90712; Lieng Hong Vang, 3390 W. Shields Ave. #101, Fresno, CA (US) 93722

( * ) Notice: Subject to any disclaimer, the term of this patent is extended or adjusted under 35 U.S.C. 154(b) by 0 days.

(21) Appl. No.: 09/470,754

(22) Filed: Dec. 23, 1999

(51) Int. Cl.[7] ..... A45D 29/00; A45D 29/18

(52) U.S. Cl. ..... 132/285; 132/73.5; 132/73

(58) Field of Search ..... 132/285, 319, 132/73, 73.5; 248/118; 206/581; 221/93, 97, 131

(56) References Cited

U.S. PATENT DOCUMENTS

| | | | | |
|---|---|---|---|---|
| D. 367,886 | | 3/1996 | Dutton, Jr. . | |
| 2,055,357 | | 9/1936 | Konecke . | |
| 2,220,758 | | 11/1940 | Florio . | |
| 2,234,657 | | 3/1941 | Smaldone . | |
| 2,262,977 | | 11/1941 | Vasil . | |
| 2,283,703 | | 5/1942 | Stedman . | |
| 3,515,154 | * | 6/1970 | Morgese | 132/285 |
| 4,915,331 | * | 4/1990 | Becker et al. | 248/118 |
| 4,930,529 | * | 6/1990 | Whitney | 132/73 |
| 5,100,324 | * | 3/1992 | Slayton | 434/87 |
| 5,228,858 | * | 7/1993 | Fromm | 434/84 |
| 5,248,096 | * | 9/1993 | Hoey et al. | 239/272 |
| 5,427,121 | * | 6/1995 | Polito | 132/285 |
| 5,454,517 | * | 10/1995 | Naemura | 239/390 |
| 5,460,087 | * | 10/1995 | Ogorzalek | 101/128.21 |
| 5,782,379 | * | 7/1998 | Traub | 221/93 |
| 5,862,811 | * | 1/1999 | Steele | 132/73 |
| 5,890,495 | * | 4/1999 | Cain | 132/73 |
| 6,080,484 | * | 6/2000 | Ujiie et al. | 428/401 |

* cited by examiner

*Primary Examiner*—Nicholas D. Lucchesi
*Assistant Examiner*—Robyn Kieu Doan

(57) ABSTRACT

A fingernail stenciling system for applying novel and decorative shapes and designs upon fingernails. The fingernail stenciling system includes a carrying case having a plurality of compartments disposed inside thereof, and also includes a stencil member having a plurality of openings therein, each opening having a distinctive design and shape, and further includes a base member, an elongate member, and a finger support member, and also includes an airbrush nozzle connected to a portable air compressor and having a hopper for holding and providing paint used to paint one's fingernails.

19 Claims, 2 Drawing Sheets

FINGERNAIL STENCILING SYSTEM

BACKGROUND OF THE INVENTION

1. Field of the Invention

The present invention relates to a fingernail painting using a specialized stencil and more particularly pertains to a new fingernail stenciling system for applying novel and decorative shapes and designs upon fingernails.

2. Description of the Prior Art

The use of fingernail painting using a specialized stencil is known in the prior art. More specifically, fingernail painting using a specialized stencil heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 2,234,657; U.S. Pat. No. 2,283,703; U.S. Pat. No. 2,262,977; U.S. Pat. No. 2,220,758; U.S. Pat. No. 2,055,357; and U.S. Pat. No. Des. 367,886.

While these devices fulfill their respective, particular objectives and requirements, the aforementioned patents do not disclose a new fingernail stenciling system. The inventive device includes a carrying case having a plurality of compartments disposed inside thereof, and also includes a stencil member having a plurality of openings therein, each opening having a distinctive design and shape, and further includes a base member, an elongate member, and a finger support member, and also includes an airbrush nozzle connected to a portable air compressor and having a hopper for holding and providing paint used to paint one's fingernails.

In these respects, the fingernail stenciling system according to the present invention substantially departs from the conventional concepts and designs of the prior art, and in so doing provides an apparatus primarily developed for the purpose of applying novel and decorative shapes and designs upon fingernails.

SUMMARY OF THE INVENTION

In view of the foregoing disadvantages inherent in the known types of fingernail painting using a specialized stencil now present in the prior art, the present invention provides a new fingernail stenciling system construction wherein the same can be utilized for applying novel and decorative shapes and designs upon fingernails.

The general purpose of the present invention, which will be described subsequently in greater detail, is to provide a new fingernail stenciling system which has many of the advantages of the fingernail painting using a specialized stencil mentioned heretofore and many novel features that result in a new fingernail stenciling system which is not anticipated, rendered obvious, suggested, or even implied by any of the prior art fingernail painting using a specialized stencil, either alone or in any combination thereof.

To attain this, the present invention generally comprises a carrying case having a plurality of compartments disposed inside thereof, and also includes a stencil member having a plurality of openings therein, each opening having a distinctive design and shape, and further includes a base member, an elongate member, and a finger support member, and also includes an airbrush nozzle connected to a portable air compressor and having a hopper for holding and providing paint used to paint one's fingernails.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new fingernail stenciling system which has many of the advantages of the fingernail painting using a specialized stencil mentioned heretofore and many novel features that result in a new fingernail stenciling system which is not anticipated, rendered obvious, suggested, or even implied by any of the prior art fingernail painting using a specialized stencil, either alone or in any combination thereof.

It is another object of the present invention to provide a new fingernail stenciling system which may be easily and efficiently manufactured and marketed.

It is a further object of the present invention to provide a new fingernail stenciling system which is of a durable and reliable construction.

An even further object of the present invention is to provide a new fingernail stenciling system which is susceptible of a low cost of manufacture with regard to both materials and labor, and which accordingly is then susceptible of low prices of sale to the consuming public, thereby making such fingernail stenciling system economically available to the buying public.

Still yet another object of the present invention is to provide a new fingernail stenciling system which provides in the apparatuses and methods of the prior art some of the advantages thereof, while simultaneously overcoming some of the disadvantages normally associated therewith.

Still another object of the present invention is to provide a new fingernail stenciling system for applying novel and decorative shapes and designs upon fingernails.

Yet another object of the present invention is to provide a new fingernail stenciling system which includes a carrying case having a plurality of compartments disposed inside thereof, and also includes a stencil member having a plurality of openings therein, each opening having a distinctive design and shape, and further includes a base member, an elongate member, and a finger support member, and also includes an airbrush nozzle connected to a portable air compressor and having a hopper for holding and providing paint used to paint one's fingernails.

Still yet another object of the present invention is to provide a new fingernail stenciling system that allows the user to easily and quickly apply paint in many different decorative shapes and designs to one's fingernails.

Even still another object of the present invention is to provide a new fingernail stenciling system that provides the user with beautiful and fashionable nail designs.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
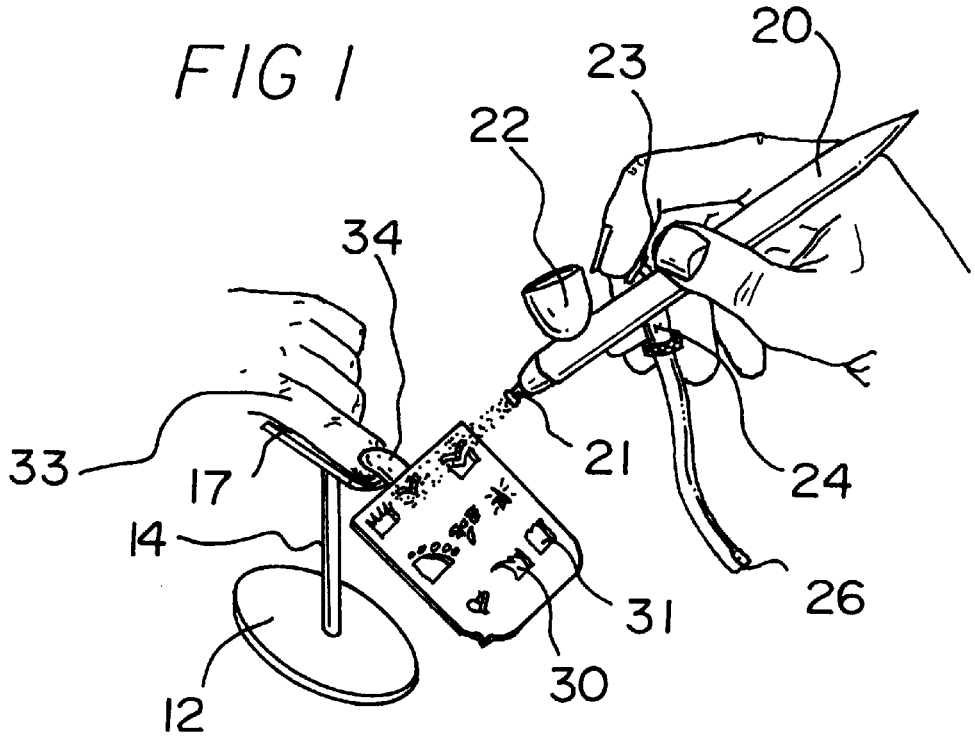
FIG. 1 is a perspective view of a new fingernail stenciling system according to the present invention as being used.
Figure 2:
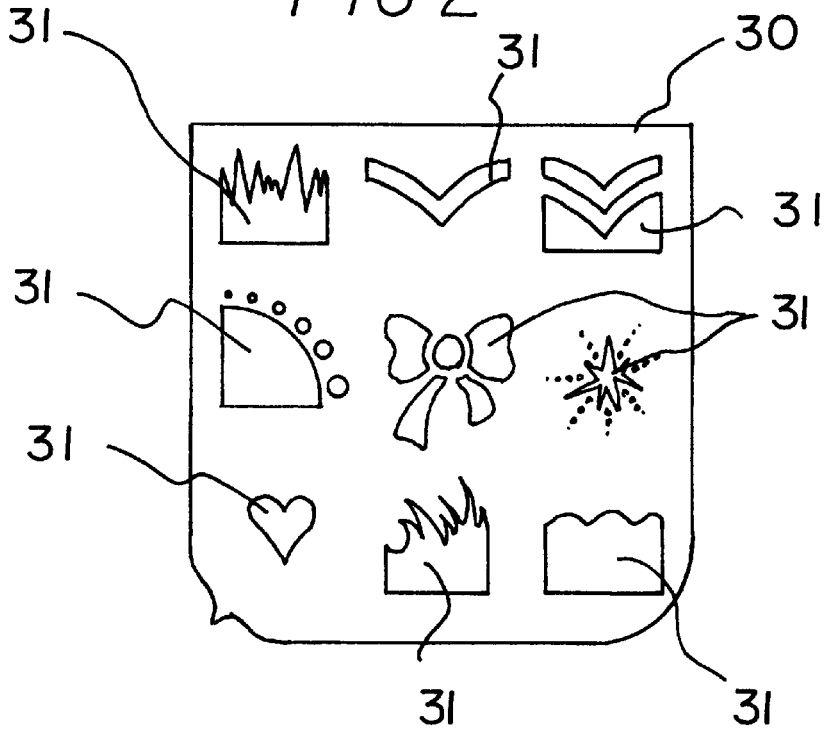
FIG. 2 is a top planar view of the stencil member of the present invention.
Figure 3:
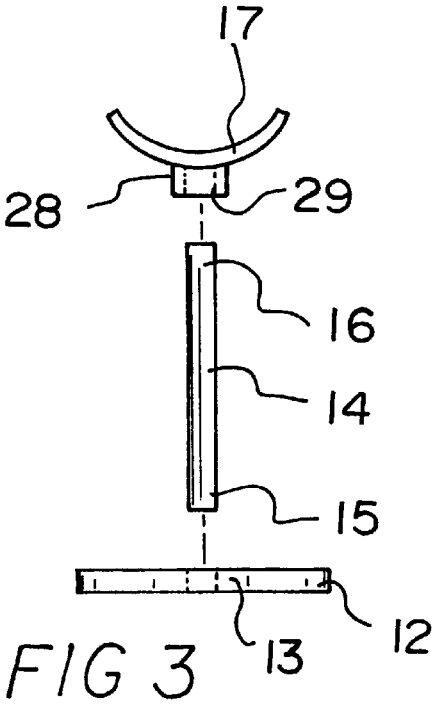
FIG. 3 is an exploded side elevational view of the base member, elongate support and the finger support member of the present invention.
Figure 4:
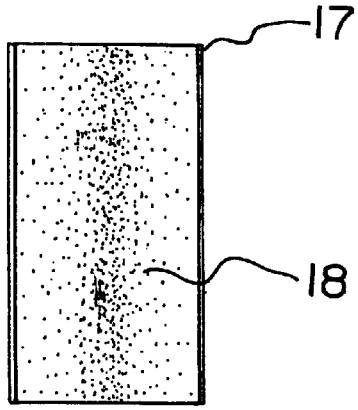
FIG. 4 is a top planar view of the plate-like member of the present invention.
Figure 5:
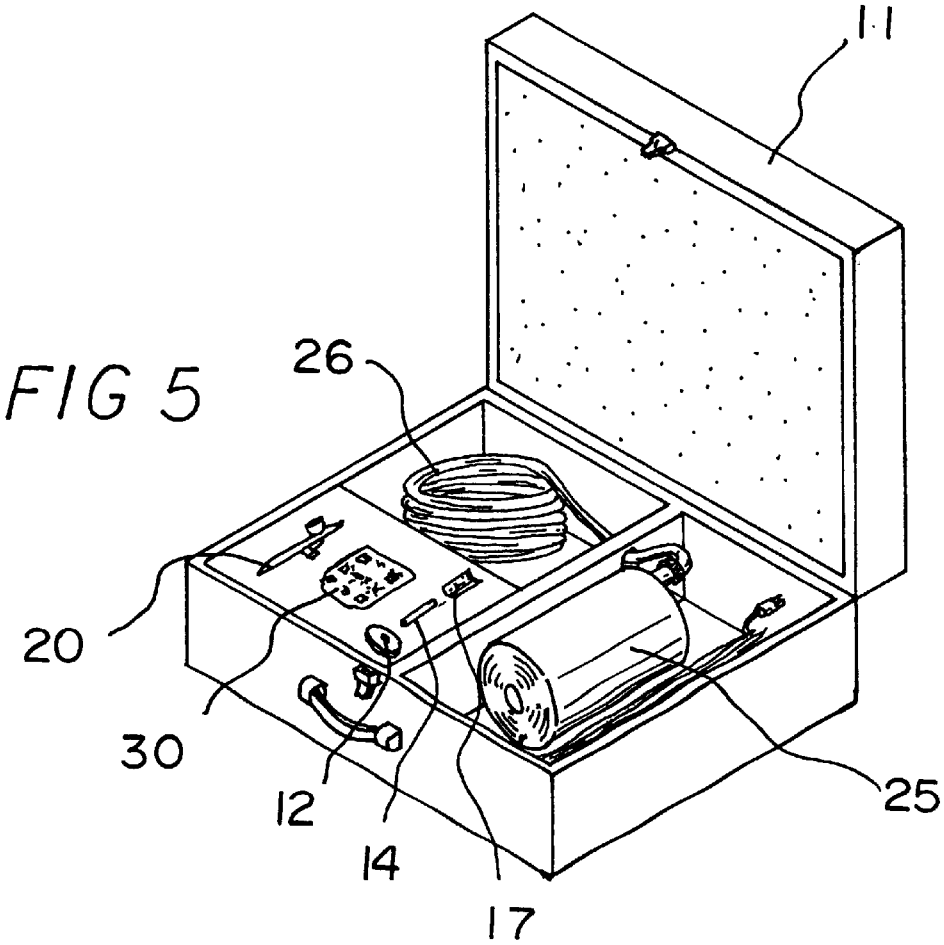
FIG. 5 is a perspective view of the present invention.

With reference now to the drawings, and in particular to FIGS. 1 through 5 thereof, a new fingernail stenciling system embodying the principles and concepts of the present invention and generally designated by the reference numeral 10 will be described.

As best illustrated in FIGS. 1 through 5, the fingernail stenciling system 10 generally comprises a carrying case 11 having a plurality of compartments disposed inside thereof. A means for supporting a person's finger 33 upon which a fingernail 34 is being stenciled is stored in the carrying case 11 and includes a base member 12, an elongate member 14 being securely attached to the base member 12 and extending vertically and upwardly therefrom, and a finger support member 17 being removeably mounted upon the elongate member 14. The base member 12 includes a hole 13 extending through a center thereof, the hole 13 being adapted to receive and support a bottom end portion 15 of the elongate member 14. The finger support member includes a laterally curved plate-like member 17 and a mounting member 28 securely and conventionally attached to a bottom side of the plate-like member 17. The mounting member 28 has a bore 29 extending through a bottom thereof with the bore 29 being adapted to receive a top end portion 16 of the elongate member 14. The plate-like member 17 includes a top side 18 having a textured surface upon which a person's finger 33 would rest.

A means of stenciling a person's fingernail 34 is stored in the carrying case 11 and includes an airbrush nozzle 20 having a bore extending therein, and having a dispensing end 21, and further. having a hopper 22 securely mounted to the airbrush nozzle 20 and extending in the bore for providing a paint material, and also having an air control member 23 disposed upon and in the nozzle 20 for controlling the dispensing of air through the airbrush nozzle 20, and a hose coupling member 24 disposed in and extending from the airbrush nozzle 20; and also includes a portable air compressor 25 having a hose 26 removeably connected to the hose coupling member 24. The means of stenciling a person's fingernail includes a stencil member 30 having a plurality of openings 31 spaced about and extending through the stencil member 30. Each of the openings 31 has a distinctive shape and decorative design for being applied to a person's fingernail 34 with each of the openings 31 being adapted to be placed upon a person's fingernail 34. The stencil member 30 is essentially a sheet which is essentially a polyester film.

In use, the user places one's finger 33 upon the plate-like member 17, and then places the selected opening 31 of the stencil member 30 upon the fingernail 34 of that finger 33, and then places the airbrush nozzle 20 containing the desired paint in the hopper 22 over the fingernail 34 and depresses the air control member 23 to release the compressed air through the bore of the airbrush nozzle 20 which sends a spray of paint from the hopper 22 through the dispensing end 21 and over the selected opening 31 in the stencil member 30 onto the fingernail 34. When completed, the user can store the stenciling items in the carrying case 11.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A fingernail stenciling system comprising:

a carrying case having a plurality of compartments disposed inside thereof;

a means for supporting a person's finger upon which a fingernail is being stenciled being stored in said carrying case;

a means of stenciling a person's fingernail also being stored in said carrying case; and wherein said means for supporting a person's finger includes a base member, an elongate member being securely attached to said base member and extending vertically and upwardly therefrom, and a finger support member being removeably mounted upon said elongate member.

2. A fingernail stenciling system as described in claim 1, wherein said base member includes a hole through a center thereof, said hole being adapted to receive and support a bottom end portion of said elongate member.

3. A fingernail stenciling system as described in claim 2, wherein said finger support member includes a laterally curved plate-like member and a mounting member securely attached to a bottom side of said plate-like member, said mounting member having a bore extending through a bottom thereof, said bore being adapted to receive a top end portion of said elongate member.

4. A fingernail stenciling system as described in claim 3, wherein said plate-like member includes a top side having a extruded surface upon which a person's finger would rest.

5. A fingernail stenciling system as described in claim 1, herein said means of stenciling a person's fingernail includes an airbrush nozzle having a bore extending therein, and having a dispensing end, and further having a hopper securely mounted to said airbrush nozzle and extending in said bore for providing a paint material, and also having an air control member disposed upon and in said nozzle for controlling the dispensing of air through said airbrush nozzle, and a hose coupling member disposed in and extending from said airbrush nozzle; and also includes a portable air compressor having a hose removeably connected to said hose coupling member.

6. A fingernail stenciling system as described in claim 5, wherein said means of stenciling a person's fingernail includes a stencil member having a plurality of openings spaced about and extending through said stencil member.

7. A fingernail stenciling system as described in claim 6, wherein each of said openings has a distinctive shape and decorative design for being applied to a person's fingernail, each of said openings being adapted to be placed upon a person's fingernail.

8. A fingernail stenciling system as described in claim 7, wherein said stencil member is essentially a sheet.

9. A fingernail stenciling system as described in claim 8, wherein said sheet is essentially a polyester film.

10. A fingernail stenciling system comprising:

a carrying case having a plurality of compartments disposed inside thereof;

a means for supporting a person's finger upon which a fingernail is being stenciled being stored in said carrying case and including a base member, an elongate member being securely attached to said base member and extending vertically and upwardly therefrom, and a finger support member being removeably mounted upon said elongate member, said base member including a hole extending through a center thereof, said hole being adapted to receive and support a bottom end portion of said elongate member, said finger support member including a laterally curved plate-like member and a mounting member securely attached to a bottom side of said plate-like member, said mounting member having a bore extending through a bottom thereof, said bore being adapted to receive a top end portion of said elongate member, said plate-like member including a top side having a textured surface upon which a person's finger would rest; and a means of stenciling a person's fingernail being stored in said carrying case and including an airbrush nozzle having a bore extending therein, and having a dispensing end, and further having a hopper securely mounted to said airbrush nozzle and extending in said bore for providing a paint material, and also having an air control member disposed upon and in said nozzle for controlling the dispensing of air through said airbrush nozzle, and a hose coupling member disposed in and extending from said airbrush nozzle; and also includes a portable air compressor having a hose removeably connected to said hose coupling member, said means of stenciling a person's fingernail including a stencil member having a plurality of openings spaced about and extending through said stencil member, each of said openings having a distinctive shape and decorative design for being applied to a person's fingernail, each of said openings being adapted to be placed upon a person's fingernail, said stencil member being essentially a sheet which is essentially a polyester film.

11. A fingernail stenciling system comprising:

a carrying case having a plurality of compartments disposed inside thereof; and a means for supporting a person's finger upon which a fingernail is being stenciled, said means for supporting being storable in said carrying case, wherein said means for supporting a person's finger includes a base member, an elongate member being securely attached to said base member and extending vertically and upwardly therefrom, and a finger support member being removeably mounted upon said elongate member.

12. A fingernail stenciling system as described in claim 11, wherein said base member includes a hole through a center thereof, said hole being adapted to receive and support a bottom end portion of said elongate member.

13. A fingernail stenciling system as described in claim 12, wherein said finger support member includes a laterally curved plate-like member and a mounting member securely attached to a bottom side of said plate-like member, said mounting member having a bore extending through a bottom thereof, said bore being adapted to receive a top end portion of said elongate member.

14. A fingernail stenciling system as described in claim 13, wherein said plate-like member includes a top side having a textured surface upon which a person's finger would rest.

15. A fingernail stenciling system as described in claim 11, further comprising:

a means of stenciling a person's fingernail includes an airbrush nozzle having a bore extending therein, and having a dispensing end, and further having a hopper securely mounted to said airbrush nozzle and extending in said bore for providing a paint material, and also having an air control member disposed upon and in said nozzle for controlling the dispensing of air through said airbrush nozzle, and a hose coupling member disposed in and extending from said airbrush nozzle; and also includes a portable air compressor having a hose removeably connected to said hose coupling member.

16. A fingernail stenciling system as described in claim 15, wherein said means of stenciling a person's fingernail includes a stencil member having a plurality of openings spaced about and extending through said stencil member.

17. A fingernail stenciling system as described in claim 16, wherein each of said openings has a distinctive shape and decorative design for being applied to a person's fingernail, each of said openings being adapted to be placed upon a person's fingernail.

18. A fingernail stenciling system as described in claim 17, wherein said stencil member is essentially a sheet.

19. A fingernail stenciling system as described in claim 18, herein said sheet is essentially a polyester film.

* * * * *